US007564439B2

(12) United States Patent
Hsieh et al.

(10) Patent No.: US 7,564,439 B2
(45) Date of Patent: Jul. 21, 2009

(54) LIQUID CRYSTAL DISPLAY WITH IMPROVED MOTION IMAGE QUALITY AND DRIVING METHOD THEREFOR

(75) Inventors: Yao-Jen Hsieh, Pingtung (TW); Huan-Hsin Li, Toufen Township, Miaoli County (TW); Chih-Sung Wang, Chubei (TW); Huan-Lin Peng, Jhudong Township, Hsinchu County (TW)

(73) Assignee: Au Optronics Corp., Hsin-Chu (TW)

( * ) Notice: Subject to any disclaimer, the term of this patent is extended or adjusted under 35 U.S.C. 154(b) by 724 days.

(21) Appl. No.: 11/287,874

(22) Filed: Nov. 28, 2005
(Under 37 CFR 1.47)

(65) Prior Publication Data

US 2006/0145992 A1 Jul. 6, 2006

(30) Foreign Application Priority Data

Dec. 31, 2004 (TW) ..... 93141906 A

(51) Int. Cl.
*G09G 3/36* (2006.01)

(52) U.S. Cl. ..... 345/98; 345/94; 345/95; 345/99; 345/100

(58) Field of Classification Search ..... 345/87–104
See application file for complete search history.

(56) References Cited

U.S. PATENT DOCUMENTS 6,894,669 B2 * 5/2005 Suzuki et al. ..... 345/87
7,362,296 B2 * 4/2008 Song et al. ..... 345/89
2002/0044115 A1 4/2002 Jinda et al. ..... 345/87
2002/0067332 A1 6/2002 Hirakata et al. ..... 345/102
2003/0001845 A1 1/2003 Willis ..... 345/443
2003/0156092 A1 * 8/2003 Suzuki et al. ..... 345/98
2003/0169247 A1 9/2003 Kawabe et al. ..... 345/204
2003/0227428 A1 12/2003 Nose ..... 345/90

OTHER PUBLICATIONS

"A Black Stripe Driving Scheme for Displaying Motion Pictires on LCDs" Nose et al.; 2001; pp. 994-997.

* cited by examiner

*Primary Examiner*—Jimmy H Nguyen
*Assistant Examiner*—Ilana Spar
(74) *Attorney, Agent, or Firm*—Thomas, Kayden, Horstemeyer & Risley, LLP

(57) ABSTRACT

A LCD (Liquid Crystal Display) with improved motion image quality and a driving method therefor. The LCD includes a pixel, a data driving circuit and a scan driving circuit. The data driving circuit generates over driving pixel data and gray pixel data according to pixel data of a Nth frame and pixel data of a (N+1)th frame, and outputs driving voltages, which correspond to the over driving pixel data, black pixel data and the gray pixel data, to the pixel at first, second and third time. The scan driving circuit outputs a scan signal at the first time, second time and third time to enable the pixel to receive the driving voltages corresponding to the over driving pixel data, the black pixel data and the gray pixel data. The driving voltages enables the pixel to generate a brightness curve similar to a pulse curve.

9 Claims, 5 Drawing Sheets

| | C1 | C2 | C3 | • • • • • • | C800 |
|---|---|---|---|---|---|
| R1 | P(1), D(1, 1~800, N) | | | | |
| R2 | P(4), D(2, 1~800, N) | | | | |
| R3 | P(7), D(3, 1~800, N) | | | | |
| ⋮ | ⋮ | | | | |
| R200 | P(598), D(200, 1~800, N) | | | | |
| R201 | P(3), G(201, 1~800, N-1) | | | | |
| R202 | P(6), G(202, 1~800, N-1) | | | | |
| R203 | P(9), G(203, 1~800, N-1) | | | | |
| ⋮ | ⋮ | | | | |
| R400 | P(600), G(400, 1~800, N-1) | | | | |
| R401 | P(2), B(401, 1~800, N-1) | | | | |
| R402 | P(5), B(402, 1~800, N-1) | | | | |
| R403 | P(8), B(403, 1~800, N-1) | | | | |
| ⋮ | ⋮ | | | | |
| R600 | P(599), B(600, 1~800, N-1) | | | | |

FIG. 5A

| | C1 | C2 | C3 | • • • • • • | C800 |
|---|---|---|---|---|---|
| R1 | P(602), B(1, 1~800, N) | | | | |
| R2 | P(605), B(2, 1~800, N) | | | | |
| R3 | P(608), B(3, 1~800, N) | | | | |
| ⋮ | ⋮ | | | | |
| R200 | P(1199), B(200, 1~800, N) | | | | |
| R201 | P(601), D(201, 1~800, N) | | | | |
| R202 | P(604), D(202, 1~800, N) | | | | |
| R203 | P(607), D(203, 1~800, N) | | | | |
| ⋮ | ⋮ | | | | |
| R400 | P(1198), D(400, 1~800, N) | | | | |
| R401 | P(603), G(401, 1~800, N-1) | | | | |
| R402 | P(606), G(402, 1~800, N-1) | | | | |
| R403 | P(609), G(403, 1~800, N-1) | | | | |
| ⋮ | ⋮ | | | | |
| R600 | P(1200), G(600, 1~800, N-1) | | | | |

FIG. 5B

| | C1 | C2 | C3 | • • • • • • | C800 |
|---|---|---|---|---|---|
| R1 | P(1203), G(1, 1~800, N) | | | | |
| R2 | P(1206), G(2, 1~800, N) | | | | |
| R3 | P(1209), G(3, 1~800, N) | | | | |
| ⋮ | ⋮ | | | | |
| R200 | P(1800), G(200, 1~800, N) | | | | |
| R201 | P(1202), B(201, 1~800, N) | | | | |
| R202 | P(1205), B(202, 1~800, N) | | | | |
| R203 | P(1208), B(203, 1~800, N) | | | | |
| ⋮ | ⋮ | | | | |
| R400 | P(1799), B(400, 1~800, N) | | | | |
| R401 | P(1201), D(401, 1~800, N) | | | | |
| R402 | P(1204), D(402, 1~800, N) | | | | |
| R403 | P(1207), D(403, 1~800, N) | | | | |
| ⋮ | ⋮ | | | | |
| R600 | P(1798), D(600, 1~800, N) | | | | |

FIG. 5C

LIQUID CRYSTAL DISPLAY WITH IMPROVED MOTION IMAGE QUALITY AND DRIVING METHOD THEREFOR

This application claims the benefit of Taiwan application Serial No. 93141906, filed Dec. 31, 2004, the subject matter of which is incorporated herein by reference.

BACKGROUND OF THE INVENTION

1. Field of the Invention

The invention relates to a LCD (Liquid Crystal Display) and a driving method therefor, and more particularly to a LCD with improved motion image quality and a driving method therefor.

2. Description of the Related Art

A conventional cathode ray tube (CRT) monitor displays a frame in an impulse type manner, and each pixel in each frame time emits light only for an instant. FIG. 1 shows a relationship between the brightness and the time in a pixel of a cathode ray tube monitor. Pixel data D1, D2 and D3 enable the pixel to generate the corresponding brightnesses I1, I2 and I3 in frame times T1, T2 and T3. Because the impulse type CRT monitor has a quick response speed, the frame that is currently displayed is free from being influenced by the brightness of a previous frame, and no image retention occurs in the motion image.

The conventional LCD displays images in a hold type manner, and the brightness of the pixel thereof is kept constant in a frame time. FIG. 2 shows a relationship between the brightness and the time in a pixel of a conventional LCD (Liquid Crystal Display). The pixel generates different brightness curves L1, L2 and L3 in the frame times T1', T2' and T3' according to different driving voltages V1, V2 and V3. As shown in FIG. 2, because the response speed of the liquid crystal molecule is smaller than the changing speed of the electric field, a period of response time is needed for the pixel to reach the target brightness. As clearly illustrated in the brightness curve L2 of FIG. 2, the brightness L2 does not reach the brightness, which should correspond to the driving voltage V2, until the frame time T2' almost elapses.

Because the response speed of the liquid crystal molecule is not high enough, retained images tend to occur when the LCD is displaying the motion images and thus influence the display quality. In the hatched area of FIG. 2, for example, because the displayed image in the frame time T2' is stilled retained at the beginning of the frame time T3', the retained image overlaps with the to-be-displayed image in the frame time T3', and the motion image quality of the LCD is thus influenced.

SUMMARY OF THE INVENTION

It is therefore an object of the invention to provide a LCD (Liquid Crystal Display) with improved motion image quality and a driving method therefor, which can enable a pixel to generate a pulse-like brightness curve to effectively improve the motion image display quality.

The invention achieves the above-identified object by providing a LCD (Liquid Crystal Display) with improved motion image quality. The LCD includes a pixel, a scan driving circuit and a data driving circuit. The pixel electrically connected to a scan line and a data line generates a predetermined brightness in a frame time. The data driving circuit generates over driving pixel data according to pixel data of a Nth frame, generates gray pixel data according to pixel data of a (N+1)th frame, and outputs driving voltages, which correspond to the over driving pixel data, black pixel data and the gray pixel data, to the pixel through the data line at a first time, a second time and a third time, respectively. The scan driving circuit outputs a scan signal to enable the pixel to receive the driving voltages corresponding to the over driving pixel data, the black pixel data and the gray pixel data through the scan line at the first time, the second time and the third time, respectively. The driving voltages corresponding to the over driving pixel data, the black pixel data and the gray pixel data enable the pixel to generate the predetermined brightness.

The invention achieves the above-identified object by providing a method for driving a pixel array of a LCD (Liquid Crystal Display) such that the pixel array finishes displaying pixel data of an Nth frame in a frame time. The pixel array includes a pixel. The driving method is described in the following. Over driving pixel data corresponding to the pixel data of the Nth frame is generated in a first subframe time, and a driving voltage corresponding to the over driving pixel data is outputted to the pixel. Next, a driving voltage corresponding to black pixel data is inputted to the pixel in a second subframe time. Finally, gray pixel data corresponding to pixel data of a (N+1)th frame is generated in a third subframe time, and a driving voltage corresponding to the gray pixel data is outputted to the pixel. The frame time includes the first subframe time, the second subframe time and the third subframe time. The driving voltages corresponding to the over driving pixel data, the black pixel data and the gray pixel data enable the pixel to generate a predetermined brightness.

Other objects, features, and advantages of the invention will become apparent from the following detailed description of the preferred but non-limiting embodiment. The following description is made with reference to the accompanying drawings.

BRIEF DESCRIPTION OF THE DRAWINGS

FIGS. 5A to 5C are schematic illustrations showing the enabled time period of each scan line and the data received by each pixel in this embodiment.

DETAILED DESCRIPTION OF THE INVENTION

Figure 1:
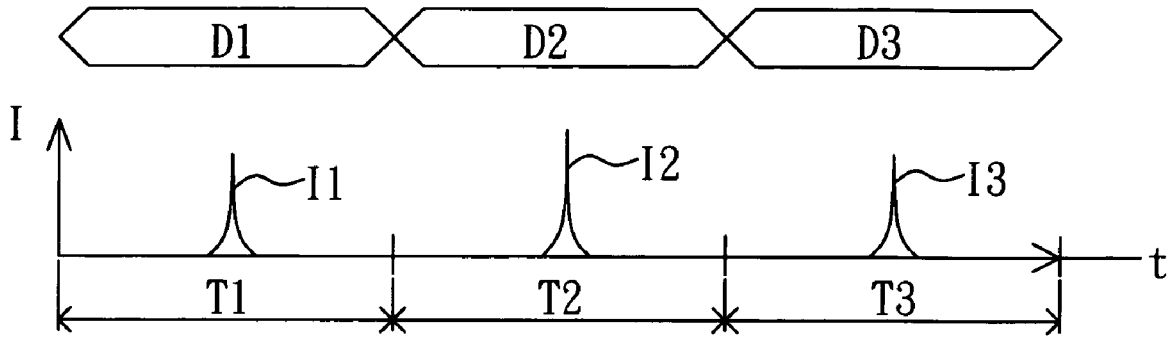
FIG. 1(RELATED ART)
FIG. 1 shows a relationship between the brightness and the time in a pixel of a cathode ray tube monitor.
Figure 2:
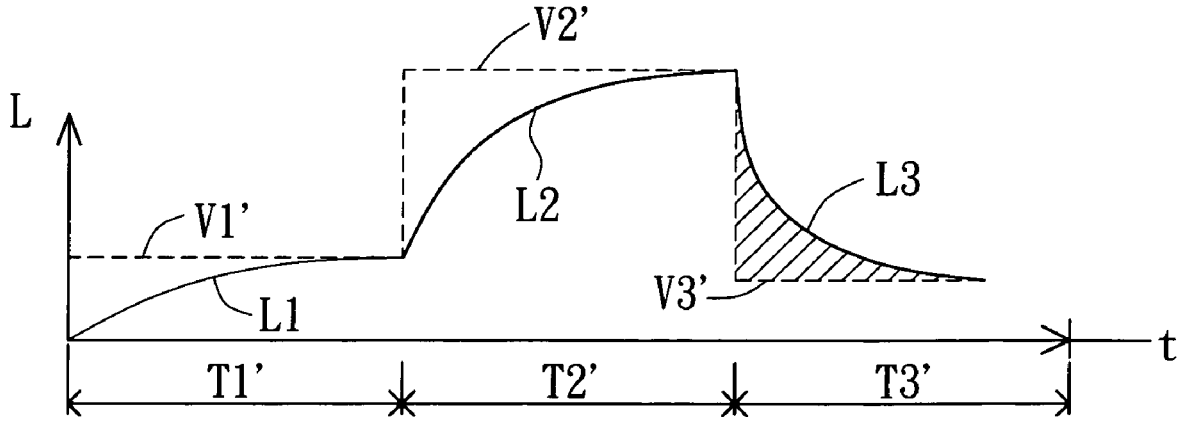
FIG. 2(RELATED ART)
FIG. 2 shows a relationship between the brightness and the time in a pixel of a conventional LCD (Liquid Crystal Display).
Figure 3:
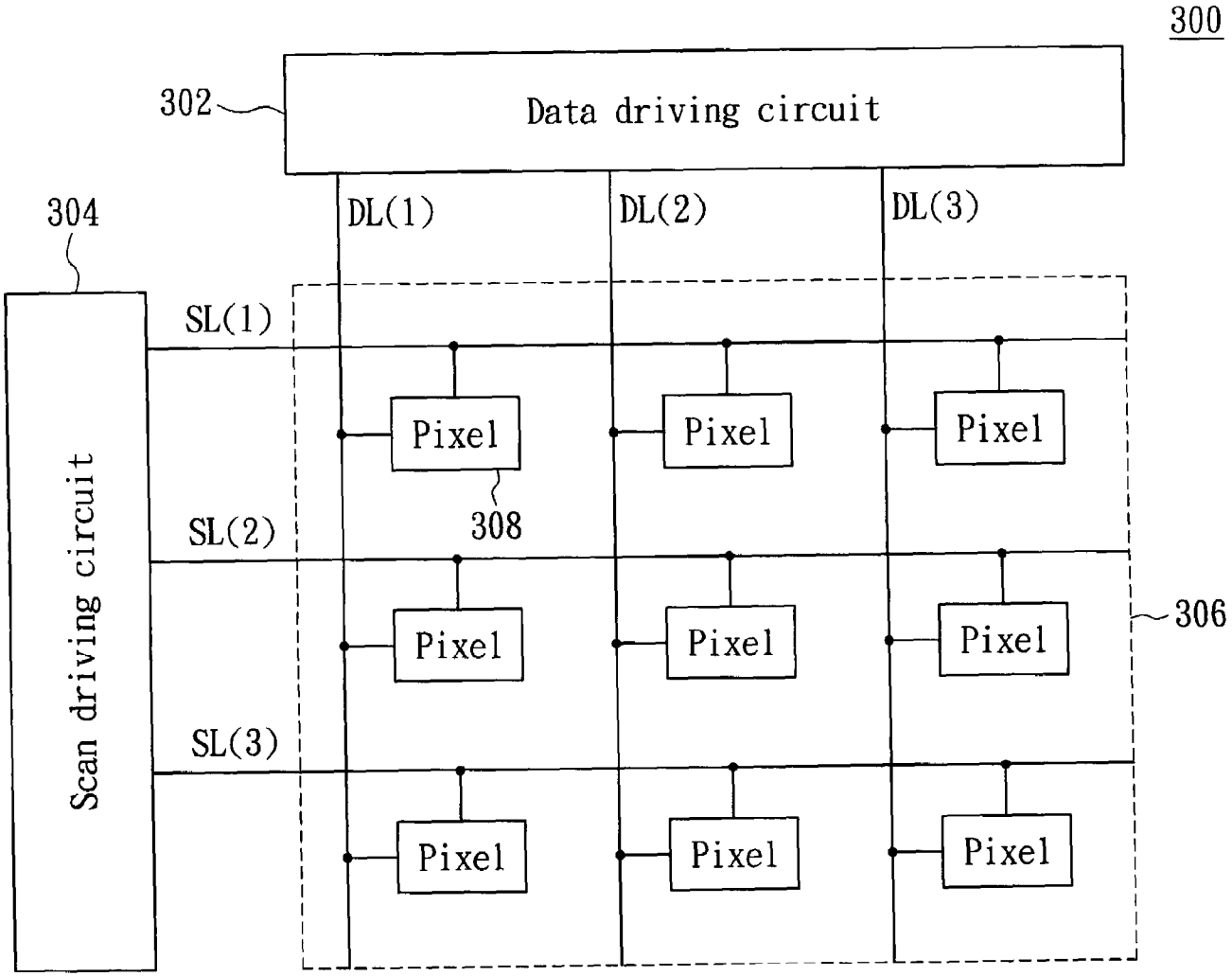
FIG. 3 is a schematic illustration showing a LCD according to a preferred embodiment of the invention.

FIG. 3 is a schematic illustration showing a LCD according to a preferred embodiment of the invention. Referring to FIG. 3, the LCD 300 includes a data driving circuit 302, a scan driving circuit 304 and a pixel array 306. The data driving circuit 302 and the scan driving circuit 304 drive the pixel array 306 through data lines DL and scan lines SL, respectively. The pixel array 306 includes a pixel, such as the pixel 308. The pixel 308 is electrically connected to the scan line SL(1) and the data line DL(1). The pixel 308 generates a predetermined brightness in a frame time. The data driving circuit 302 generates over driving pixel data D according to pixel data I of a Nth frame and gray pixel data G according to pixel data I' of a (N+1)th frame, and outputs driving voltages, which correspond to the over driving pixel data D, black pixel data B and the gray pixel data G, to the pixel 308 through the data line DL(1) at a first time t1, a second time t2 and a third time t3 (FIG. 4).

The scan driving circuit 304 outputs a scan signal SL' through the scan line SL(1) to enable the pixel 308 to receive the driving voltages corresponding to the over driving pixel data D, the black pixel data B and the gray pixel data G at the first time t1, the second time t2 and the third time t3. The driving voltages corresponding to the over driving pixel data D, the black pixel data B and the gray pixel data G enable the pixel 308 to generate the predetermined brightness and enable the pixel 308 to generate a brightness curve similar to a pulse curve.

Figure 4:
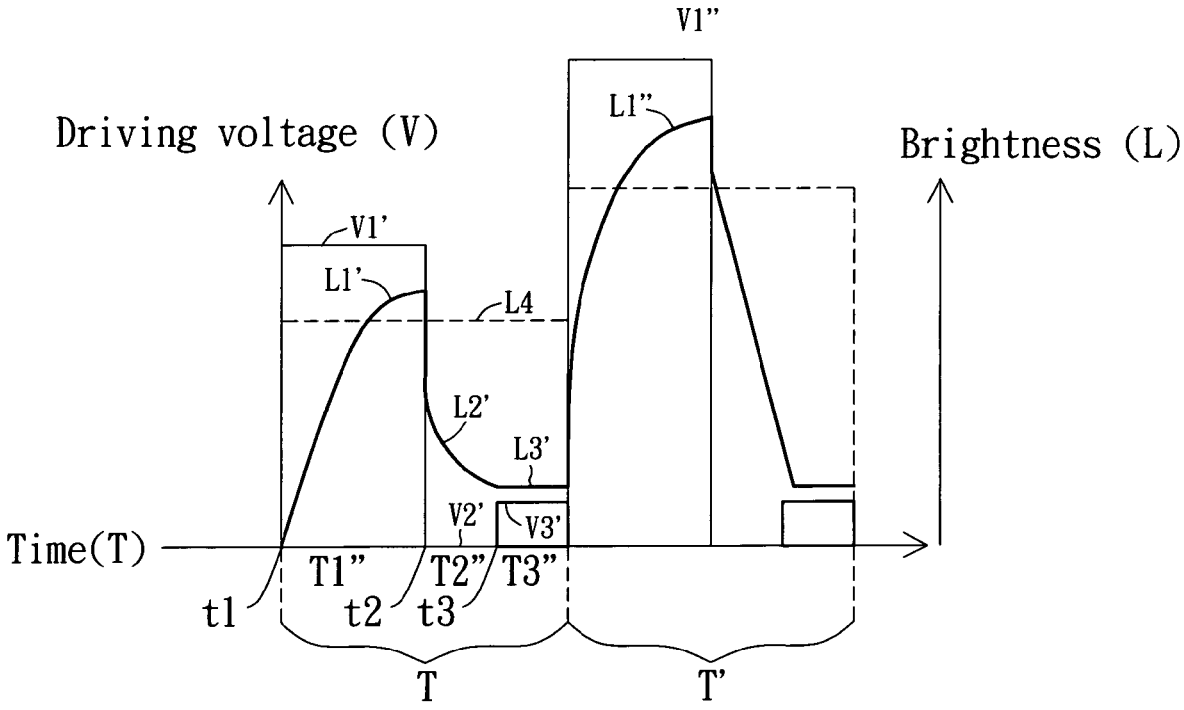
FIG. 4 is a graph showing a relationship between a driving voltage and the brightness of the pixel 308.

In further detail, FIG. 4 is a graph showing a relationship between a driving voltage and the brightness of the pixel 308. The pixel 308 displays the predetermined brightness corresponding to the pixel data I of the Nth frame in a frame time. In the driving method of this embodiment, the frame time T for each frame is divided into a first subframe time T1", a second subframe time T2" and a third subframe time T3", and the time length ratio of the subframe time T1" to T2" to T3" may be determined according to the display effect to be achieved. Preferably, for example when the ratio is 2:1:1, the generated motion image quality is better.

In the first field time T1", the corresponding over driving pixel data D is generated after the pixel data I is properly calculated. For example, the over driving pixel data D may be obtained by looking a look up table according to the pixel data I. The data driving circuit 302 outputs the voltage V1' corresponding to the over driving pixel data D to the pixel 308 at the first time t1, such that the pixel 308 generates a first brightness L1'. The first time t1 is the initial time of the first subframe time T1".

In the second subframe time T2", the data driving circuit 302 outputs the voltage V2' corresponding to the black pixel data B to the pixel 308 at the second time t2, such that the pixel 308 generates a second brightness L2', wherein the voltage V2' corresponds to the darkest gray-scale value to perform an impulse type brightness. The second time t2 is the initial time of the second subframe time T2".

In the third subframe time T3", the data driving circuit 302 outputs the voltage V3' corresponding to the gray pixel data G to the pixel 308 at the third time t3, such that the liquid crystal molecule of the pixel 308 tilts at a pre-tilt angle and generates a third brightness L3'. The pre-tilt angle can speed up the response of the liquid crystal molecule of the pixel 308 to the orientation corresponding to the pixel data I' of the (N+1)th frame. So, the gray pixel data G is generated according to the pixel data I' of the (N+1)th frame such that the response speed of the liquid crystal molecule is increased, and the image display can be speeded up. Similarly, the third time t3 is the initial time of the third subframe time T3".

The equivalent brightness of the brightnesses L1', L2' and L3' corresponds to the predetermined brightness of the pixel data I, and the predetermined brightness is, for example, the dashed line L4 of FIG. 4. The spirit of the embodiment is to effectively improve the motion image display quality by making the brightness curve formed by L1', L2' and L3' similar to the impulse curve. That is, the curve formed by connecting the brightnesses L1', L2' and L3' shows the following features. Because the driving voltage V1' in the first subframe time T1" is greater than that of the prior art, the rise response time of the brightness L1' is shorter than that of the conventional driving method. Next, the driving voltage V2' in the second filed time T2" corresponds to the black pixel data B, so the brightness L2' of the pixel 308 rapidly decreases to form the similar impulse curve. Thus, the phenomenon of human vision retention caused by the conventional hold type display method can be reduced so that the motion image quality can be enhanced. Finally, in the third subframe time T3", the liquid crystal molecule tilts at a pre-tilt angle according to the driving voltage V3' corresponding to the gray pixel data G. The pre-tilt angle can shorten the time for the liquid crystal molecule of the pixel 308 to response to a next brightness. For example, as shown in the frame time T' of the (N+1)th frame, when the pixel 308 is requested to display a higher brightness, the pixel 308 can reach the desired brightness L1" corresponding to the driving voltage V1" in the (N+1)th frame according to the driving voltage V3' of the frame time T of the Nth frame. The value of the driving voltage V3' is determined according to the property of the liquid crystal molecule and the pixel data I' of the next frame ((N+1)th frame), such that the liquid crystal molecule tilts at an optimum pre-tilt angle.

Figure 6:
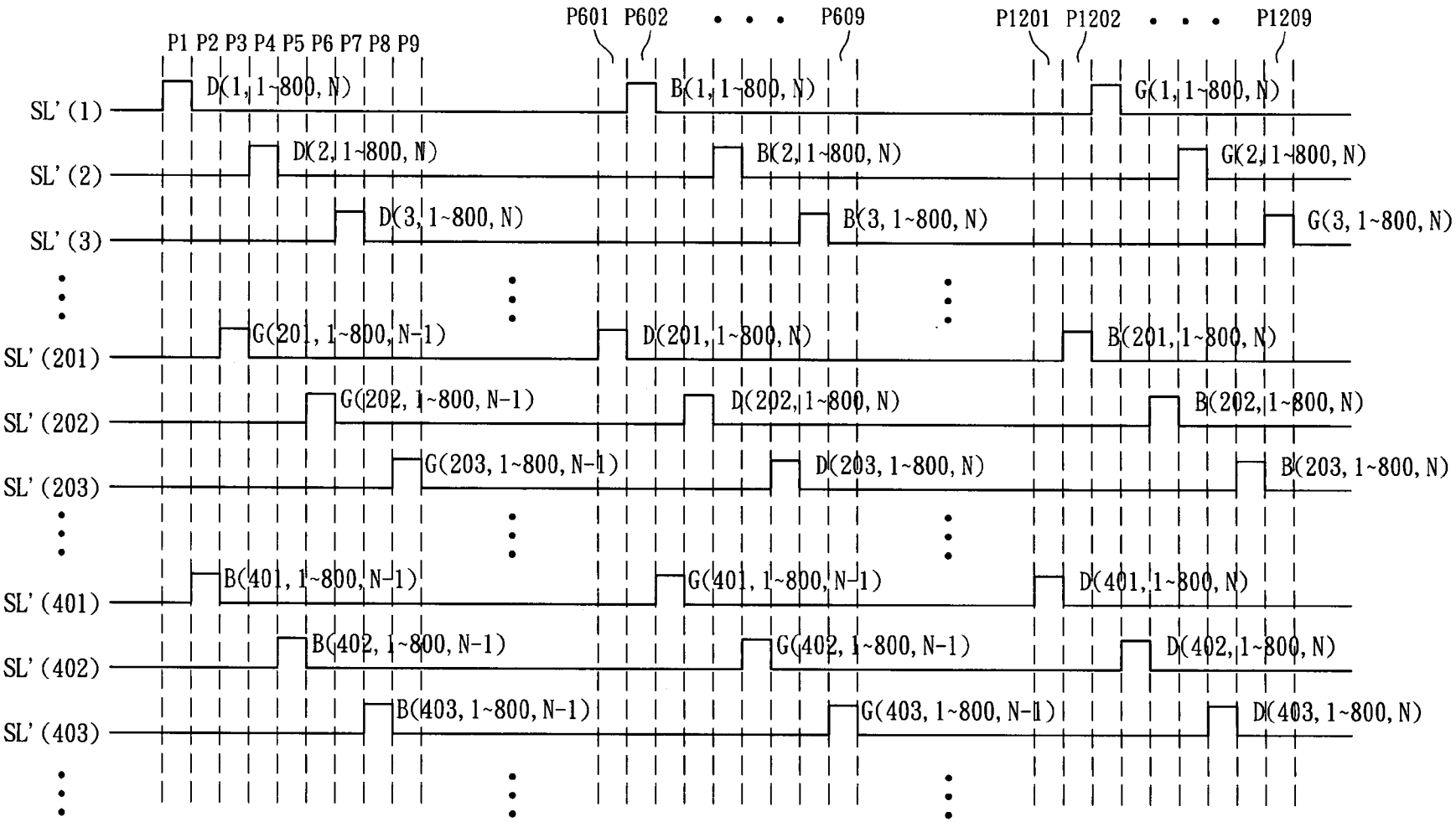
FIG. 6 shows waveforms of the scan signal SL' corresponding to FIGS. 5A to 5C.

For the sake of easy description, an example of a display with a resolution of 800*600 (i.e., the display has a pixel array 306 with 600 rows and 800 columns) will be described. The relationship between the time period when the scan line is enabled and the pixel data received by each pixel in this embodiment will be further described according to an example, in which the time length ratio of the subframe time T1" to T2" to T3" is 1:1:1, that is, each subframe time occupies one third of the frame time T. FIGS. 5A to 5C are schematic illustrations showing the enabled time period of each scan line and the data received by each pixel in this embodiment. FIG. 6 shows waveforms of the scan signal SL' corresponding to FIGS. 5A to 5C. As shown in FIGS. 5A to 5C and FIG. 6, R1 to R600 represent 600 rows of pixels of the LCD 300, and C1 to C800 represent 800 columns of pixels of the LCD 300, respectively. It is assumed that the LCD 300 finishes the scanning of one frame in 1800 periods P(1) to P(1800).

As shown in FIGS. 5A and 6, when the Nth frame is to be displayed, the scan driving circuit 304 firstly enables the scan signal SL'(1) inputted to the scan line SL(1) in the time period P(1) so as to turn on the first row R1 of pixels. Meanwhile, the data driving circuit 302 outputs the driving voltages, which correspond to the over driving pixel data D(1, 1~800, N) of the first to 800-th columns of pixels of the first row R1 of pixels of the Nth frame, to the first row R1 of pixels in the time period P(1), such that the first row R1 of pixels displays the brightness corresponding to the over driving pixel data D of the Nth frame in the first period P(1), and the first row of FIG. 5A is denoted as P(1), D(1, 1~800, N). Next, the scan driving circuit 304 enables the 401-th row R401 of pixels to enable the pixels of R401 to receive the driving voltages corresponding to the black pixel data B(401, 1~800, N−1) of the (N−1)th frame in the second period P(2). Then, the scan driving circuit 304 enables the 201-th row R201 of pixels to enable the pixels of R201 to receive the driving voltages corresponding to the gray pixel data G (i.e., the driving voltages corresponding to the darkest brightness), which are, for example, the driving voltages corresponding to the gray pixel data G(201, 1~800, N−1) of the (N−1)th frame, in the third period P(3). The thin film transistor of each pixel is only turned on once in one frame time in the conventional driving method, so the periods P(1), P(2) and P(3) of FIG. 6 correspond to the conventional periods when one scan signal is enabled.

According to this sequence, the pixels of R2 to R200 are caused to receive the voltages corresponding to the over driving pixel data D(2, 1~800, N), D(3, 1~800, N) to D(200, 1~800, N) of the Nth frame in the periods P(4), P(7) to P(598), respectively. The pixels of R402 to R600 are caused to receive the driving voltages corresponding to the black pixel data B(402, 1~800, N−1), B(403, 1~800, N−1) to B(600, 1~800, N−1) of the (N−1)th frame in the periods P(5), P(8) to P(599), respectively. Also, the pixels of R202 to R400 are caused to receive the voltages corresponding to the gray pixel data G(202, 1~800, N−1), G(203, 1~800, N−1) to G(400, 1~800, N−1) of the (N−1)th frame in the periods P(6), P(9) to P(600), respectively.

Similarly, the pixels of R201 to R400 are caused to receive the driving voltages corresponding to the over driving pixel data D(201, 1~800, N), D(202, 1~800, N) to D(400, 1~800, N) of the Nth frame in the periods P(601), P(604) to P(1198), respectively. The pixels of R1 to R200 are caused to receive the driving voltages corresponding to the black pixel data B(1, 1~800, N), B(2, 1~800, N) to B(200, 1~800, N) of the Nth frame in the periods P(602), P(605) to P(1199), respectively. The pixels of R401 to R600 are caused to receive the driving voltages corresponding to the gray pixel data G(401, 1~800, N−1), G(402, 1~800, N−1) to G(600, 1~800, N−1) of the (N−1)th frame in the periods P(603), P(606) to P(1200), respectively.

Next, the pixels of R401 to R600 are caused to receive the driving voltages corresponding to the over driving pixel data D(401, 1~800, N), D(402, 1~800, N) to D(600, 1~800, N) of the Nth frame in the periods P(1201), P(1204) to P(1798), respectively. The pixels of R201 to R400 are caused to receive the voltages corresponding to the black pixel data B(201, 1~800, N), B(202, 1~800, N) to B(400, 1~800, N) of the Nth frame in the periods P(1202), P(1205) to P(1799), respectively. The pixels of R1 to R200 are caused to receive the driving voltages corresponding to the gray pixel data G(1, 1~800, N), G(2, 1~800, N) to G(200, 1~800, N) of the Nth frame in the periods P(1203), P(1206) to P(1800), respectively. After the period P(1800), the voltages corresponding to the over driving pixel data D of the Nth frame have been completely inputted. After the above-mentioned steps have been repeated, the driving voltages corresponding to the black pixel data B and the gray pixel data G of the Nth frame can be completely inputted, such that the object of setting the time length ratio of the subframe times T1" to T2" to T3" of this embodiment to be 1:1:1 can be achieved.

According to the above-mentioned scan method, each pixel in the pixel array can generate the brightness curve similar to the pulse curve. Other scan methods, however, also may be used. The effect of this embodiment can be achieved as long as the pixel can be turned on three times, in one frame time, to receive three different driving voltages, which correspond to the driving voltages of the over driving pixel data, the black pixel data and the gray pixel data.

In the LCD and the driving method therefor of the embodiment, one frame time is divided into three parts and three different driving voltages are generated to enable the pixel to generate the pulse-like brightness curve. Thus, the phenomenon of human vision retention caused by the conventional hold type display method may be reduced, and the motion image display quality can be enhanced.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A liquid crystal display (LCD), comprising:

a pixel corresponding to a scan line and a data line and generating a predetermined brightness during a frame time;

a data driving circuit for generating over driving pixel data according to pixel data of only a Nth frame, generating gray pixel data according to pixel data of a (N+1)th frame, and outputting driving voltages corresponding to the over driving pixel data, black pixel data and the gray pixel data to the pixel through the data line at a first time, a second time and a third time, respectively; and a scan driving circuit for outputting a scan signal to enable the pixel to receive the driving voltages corresponding to the over driving pixel data, the black pixel data and the gray pixel data through the scan line at the first time, the second time and the third time, respectively;

wherein the driving voltages corresponding to the over driving pixel data, the black pixel data and the gray pixel data enable the pixel to generate a first brightness, a second brightness and a third brightness, respectively, and an equivalent brightness of the first brightness, the second brightness and the third brightness substantially equals to the predetermined brightness.

2. The LCD according to claim 1, wherein the voltage corresponding to the gray pixel data enables a liquid crystal molecule of the pixel to tilt a pre-tilt angle, thereby speeding up a response of the liquid crystal molecule of the pixel to an orientation corresponding to the pixel data of the (N+1)th frame.

3. The LCD according to claim 1, wherein a time length ratio for keeping the pixel at the first brightness, the second brightness and the third brightness is substantially 2:1:1.

4. The LCD according to claim 1, wherein a time length ratio for keeping the pixel at the first brightness, the second brightness and the third brightness is substantially 1:1:1.

5. A method for driving a pixel array of a liquid crystal display (LCD) to display pixel data of only a Nth frame during a frame time, the pixel array comprising at least one pixel, the method comprising:

generating over driving pixel data corresponding to the pixel data of the Nth frame in a first subframe time and outputting a driving voltage corresponding to the over driving pixel data to the pixel;

applying a driving voltage corresponding to black pixel data to the pixel in a second subframe time; and generating gray pixel data corresponding to the pixel data of (N+1)th frame in a third subframe time and outputting a driving voltage corresponding to the gray pixel data to the pixel, wherein the driving voltages corresponding to the over driving pixel data, the black pixel data and the gray pixel data enable the pixel to generate a predetermined brightness; and the frame time comprises the first subframe time, the second subframe time and the third subframe time.

6. The method according to claim 5, wherein a time length ratio of the first subframe time to the second subframe time to the third subframe time is substantially 2:1:1.

7. The method according to claim 5, wherein a time length ratio of the first subframe time to the second subframe time to the third subframe time is substantially 1:1:1.

8. The method according to claim 5, wherein the over driving pixel data is obtained from a look up table.

9. The method according to claim 5, wherein the driving voltage corresponding to the gray pixel data enables a liquid crystal molecule of the pixel to tilt a pre-tilt angle, thereby speeding up a response of the liquid crystal molecule of the pixel to an orientation corresponding to the pixel data of the (N+1)th frame.

* * * * *